United States Patent [19]

Brown

[11] 4,022,999

[45] May 10, 1977

[54] PLURAL-CIRCUIT PROGRESSIVE SWITCH

[75] Inventor: Harry W. Brown, Big Bend, Wis.

[73] Assignee: Cutler-Hammer, Inc., Milwaukee, Wis.

[22] Filed: Oct. 7, 1975

[21] Appl. No.: 620,371

[52] U.S. Cl. ..... 200/67 G; 200/6 BA

[51] Int. Cl.[2] ..... H01H 13/28

[58] Field of Search ..... 200/67 G, 68, 6 BB, 200/6 C, 6 R, 6 A

[56] References Cited

UNITED STATES PATENTS

| | | | |
|---|---|---|---|
| 3,169,172 | 2/1965 | Hagberg | 200/68 |
| 3,482,067 | 12/1969 | Sanford | 200/67 G |
| 3,825,711 | 7/1974 | Lewis | 200/67 G |

FOREIGN PATENTS OR APPLICATIONS

| | | | |
|---|---|---|---|
| 593,175 | 5/1959 | Italy | 200/67 G |

*Primary Examiner*—David Smith, Jr.

*Attorney, Agent, or Firm*—Hugh R. Rather; William A. Autio; Michael E. Taken

[57] ABSTRACT

A rocking contactor switch of the two-circuit progressive action type having three spaced stationary contacts, a flexible contactor connected to the first stationary contact and self-biased to disengage the second stationary contact, and a three-position rocking contactor. The switch is operable from an "off" position wherein the rocking contactor engages only the first stationary contact and the flexible contactor to a one circuit "on" position wherein the rocking contactor rocks over to press the flexible contactor into engagement with the second stationary contact while remaining in engagement with the first stationary contact, and then to a two circuit "on" position wherein the rocking contactor rocks further to engage the third stationary contacts while maintaining the flexible contactor pressed against the second stationary contact thereby to connect electrically all three stationary contacts.

7 Claims, 4 Drawing Figures

PLURAL-CIRCUIT PROGRESSIVE SWITCH

BACKGROUND OF THE INVENTION

Two-circuit progressive switches have been known heretofore. However, these prior switches have had certain disadvantages such as complex contact arrangements involving higher manufacturing costs, requiring a special actuator and thus not adaptable for use with a plurality of conventional actuators etc. For example, R. E. Larkin U.S. Pat. No. 2,936,347, dated May 10, 1960, shows a two-circuit progressive toggle switch that requires a plunger actuator having a special configuration for laterally deflecting a flexible contactor finger. And H. W. Brown U.S, Pat. No. 3,196,220, dated July 20, 1965, shows two-circuit progressive switches having complex contact configurations in each of the three versions disclosed therein. While these prior switches have been useful for their intended purposes, this invention relates to improvements thereover.

SUMMARY OF THE INVENTION

An object of the invention is to provide an improved plural-circuit progressive switch.

A more specific object of the invention is to provide an improved plural-circuit progressive switch having lower manufacturing cost.

Another specific object of the invention is to provide an improved plural-circuit switch that is simple in construction and efficient and reliable in operation.

Another specific object of the invention is to provide an improved plural-circuit switch that is operable by any one of a plurality of different pivoted or slidable actuators.

Another specific object of the invention is to provide an improved two-circuit progressive switch especially adapted for applications where the first circuit requires only a small current whereas the second circuit must carry a much larger current.

Other objects and advantages of the invention will hereinafter appear.

DESCRIPTION OF THE PREFERRED EMBODIMENT

Figure 1:
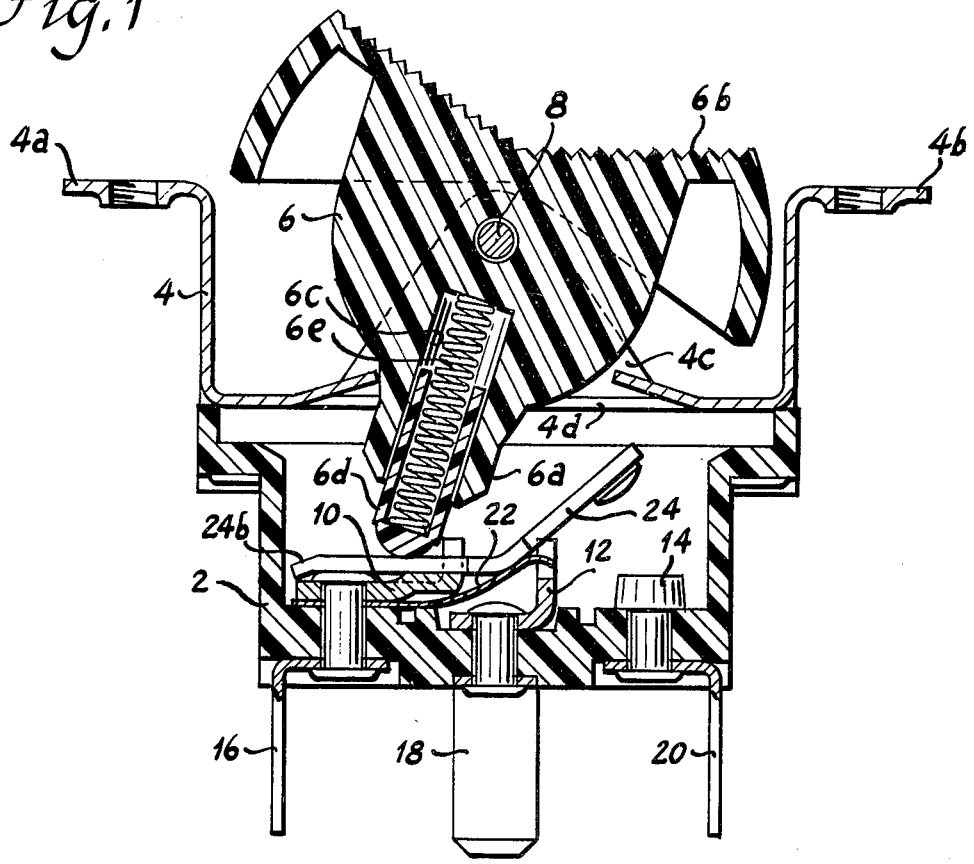
FIG. 1 is an enlarged cross-sectional view of a single-pole rocker switch taken along the contacts to show the two-circuit progressive contacts in their "off" position.

Referring to FIG. 1, there is shown a rocker switch of the two-circuit progressive type constructed in accordance with the invention. Progressive refers to the direct onward motion whereby the switch may be operated from "off" position to the first "on" (first circuit closed) position and then further to the second "on" (first and second circuits closed) position.

This switch is provided with a housing comprising a cup-shaped insulating base 2 and a metal frame 4 closing the top of the base and pivotally supporting a rocker button 6 for actuating the switch. The base may be attached to the frame by any suitable means such as, for example, by bending depending tabs of the frame below the offset upper corners of the base to clamp the two securing to one another.

The frame is provided with mounting means comprising forward and rearward upwardly-offset horizontal extensions **4*a* and 4*b*** having holes for flush-mounting the switch to a supporting panel or the like.

The frame is also provided with means for mounting rocker button 6. This means comprises a pair of spaced, upright, generally triangular bent-up stanchions **4*c*, one of which is shown in FIG. 1, having aligned round holes therethrough for receiving a lateral pivot pin 8 that supports the rocker button. The frame also is provided with a central rectangular aperture 4*d* through which actuating portion 6*a* of the rocker button extends into the base and for providing clearance for rocking thereof. Extensions 4*a* and 4*b* are offset upwardly substantially to the top of stanchions 4*c* to provide therewith an enclosure accommodating the rocker button except for its extreme upper, finger-engaging portion 6*b* that is accessible thereabove for manipulation by the user. Upper portion 6*b* of the rocker button has the conventional shallow V-shaped and grooved upper surface and curved ends to substantially fill the space between extensions 4*a* and 4*b* and stanchions 4*c*** in any position thereof.

Base 2 is a generally cup-shaped molded insulating member and is provided with a row of three spaced-apart aligned holes through its bottom for receiving rivets that connect stationary contacts 10, 12 and 14 to external terminals 16, 18 and 20, respectively. The apertured end of flexible contactor 22 extends below stationary contact 10 and is clamped to the base by the associated rivet passing through the aperture therein. Rocking contactor 24 overlies the stationary contacts and flexible contactor 22.

Figure 4:
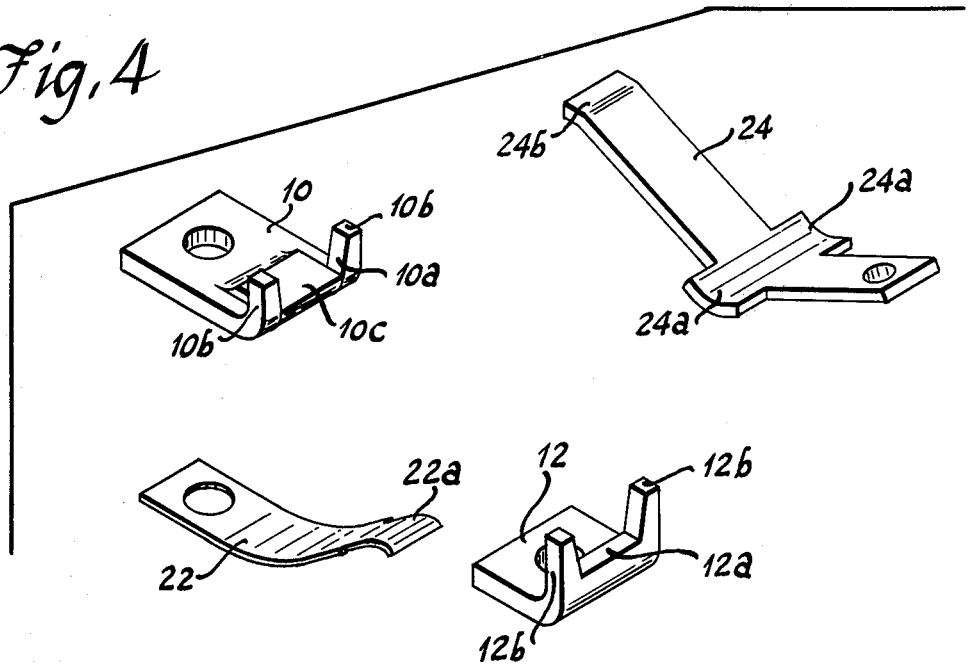
FIG. 4 is an isometric view of the first and second stationary contacts, the flexible contactor and the rocking contactor in exploded relation.

As shown in FIG. 4, stationary contact 10 has a hole at its left end through which its mounting rivet passes and its right end is provided with a slightly diverging notch at the center leaving two projections **10*b* that are bent upwardly to provide the left side of a cradle for the rocking contactor. The horizontal portion 10*c* of contact 10 immediately adjacent these upward projections is offset slightly upwardly to provide an upper surface at the level of the associated rivet head. This will insure disengagement between the rocking contactor and middle contact 12 when the switch is operated to its "off" position shown in FIG. 1.**

Figure 2:
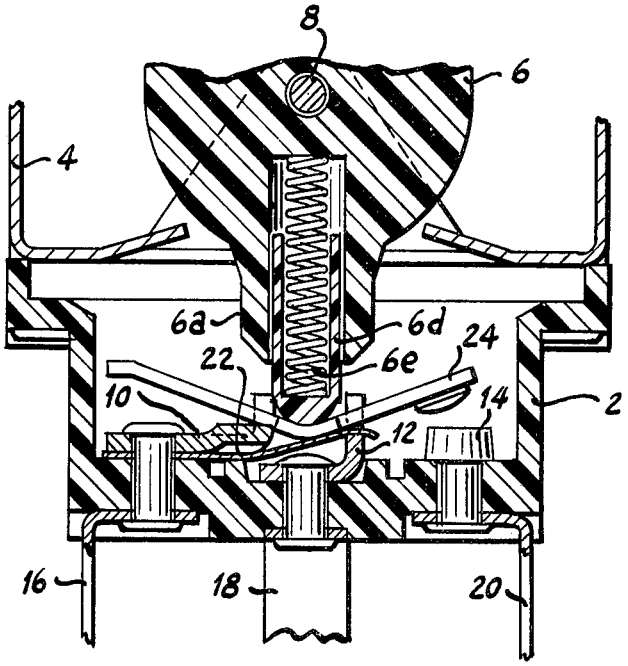
FIG. 2 is a cross-sectional view like FIG. 1, minus the upper part of the rocker button, showing the contacts in their first "on" position for closing a low current circuit.

Stationary contact 12 provides the right side of the aforementioned cradle for the rocking contactor. Thus, contact 12 is an angular member having a hole through its horizontal portion through which its mounting rivet passes. Its upturned right-hand portion is provided with a slightly diverging notch **12*a* at the middle leaving two projections 12*b* that provide the right side of the cradle for the rocking contactor as shown in FIGS. 2 and 4. Also, the upwardly biased right end 22*a* of flexible contactor 22 extends into this notch in stationary contact 12 and is normally separated therefrom, being inherently biased up against the rocking contactor as shown in FIG. 1 when the switch is off. As shown in FIG. 1, notch 12*a* in contact 12 extends down slightly lower than notch 10*a* in contact 10 so that when the thickness of the flexible contactor is added thereto as shown in FIG. 2, they will have the same height. This effects separation of the wings of rocking contactor 24 from contact 12** when operated to off position.

Stationary contact 14 preferably consists of the head of the rivet that extends through the bottom of the base and to which terminal 20 is secured. This rivet head contact is suitably shaped for engagement by the rocking contactor when the switch is operating to its two-circuit position.

As aforementioned, flexible contactor 22 has its right end formed upwardly and its tip curved back down where it overlies the notch in stationary contact 12. Thus, this flexible contactor will be self-biased at all times against the lower surface of rocking contactor 24 to follow the motion of the latter into engagement or disengagement with stationary contact 12.

Rocking contactor 24 is a stiff elongated strip of metal having a pair of lateral wings 24*a* as shown in FIG. 4, these two wings extending in opposite directions at substantially the midpoint of this contactor strip. This contactor is bent on an axis extending through the center of these wings so that the opposite ends extend up at a small angel from the horizontal plane, thus to provide a rockable member. One of these wings extends between the two rear upward projections of stationary contacts 10 and 12 and the other wing extends between the two front upward projections of these stationary contacts to keep the rocking contactor from slipping out of its position. The left tip 24*b* of this rocking contactor is curved downwardly for camming on the rivet head of stationary contact 10 to insure that the rocking contactor will rock clear of and will not slip to the right when the switch is operated to its off position shown in FIG. 1. This insures that the rocking contactor will disengage stationary contact 12 when the switch is off.

Rocker button 6 is provided with a bore 6*c* extending partway up into its reduced actuator portion 6*a*. A plunger 6*d* is retained in this bore and is biased downwardly by a helical compression spring 6*e* to maintain proper contact pressure as the tip of this plunger slides along the rocking contactor.

When the switch is in its off position as shown in FIG. 1, plunger 6*d* presses the rocking contactor against horizontal offset surface 10*c* (FIG. 4) of stationary contact 10 and against the rivet head associated therewith. The downwardly bent tip 24*b* of the rocking contactor is cammed on the rivet head to maintain wings 24*a* of the rocking contactor spaced from upward projections 12*b* of stationary contact 12. End 22*a* of the flexible contactor is biased against rocking contactor 24 and thus is spaced from stationary contact 12.

When the rocker button is rocked counter-clockwise to its center position shown in FIG. 2, the plunger slides along the rocking contactor into the dip formed by the aforesaid bend therein. This causes the rocking contactor to rock clockwise, to press flexible contactor 22 down into the bottom of notch 12*a*, and to stop in a state of equilibrium resting in the notches of contacts 10 and 12. As a result, terminals 16 and 18 are electrically connected by flexible contactor 22 and rocking contactor 24.

Figure 3:
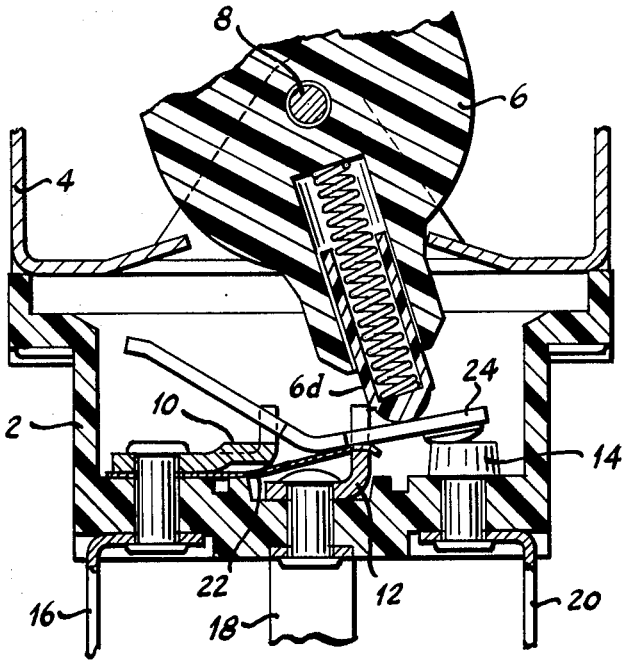
FIG. 3 is a cross-sectional view like FIG. 2 showing the contacts in their second "on" position for maintaining the low current circuit of FIG. 2 and additionally closing a high current circuit.

Further counter-clockwise rocking of the rocker button to the two-circuit position shown in FIG. 3, causes the right end of the rocking contactor to engage stationary contact 14 while maintaining flexible contactor 22 pressed against stationary contact 12. Although, the rocking contactor has now disengaged contact 10, flexible contactor 22 maintains contacts 10 and 12 connected to close a low current circuit. Contactor 24 maintains contacts 12 and 14 connected to close a high current circuit.

Return clockwise rocking of the rocker button will operate the switch from its two-circuit position to its one-circuit position and then to its off position. In the two-circuit position shown in FIG. 3, the circuit connected to terminals 16 and 18 is a low current circuit since flexible contactor 22 made of thin bronze or the like is adapted for carrying a low current. On the other hand, the circuit connected to terminals 18 and 20 may be a high current circuit because rocking contactor 24 is adapted to carry a higher current. This switch has application especially on projectors for running the fan or both the fan and the lamp, the fan requiring much higher current.

While a single pole switch has been shown, it will be apparent that the invention may readily be applied to doublepole switches by providing a second set of similar contacts separated by a dividing wall in the base from the set of contacts shown, and providing a second plunger on the rocker button which rocker button would be grooved to straddle the dividing wall.

It will be apparent from the foregoing that any one of a plurality of different types of actuators may be used to operate this switch. For example, any actuator having the conventional plunger such as plunger 6*d* may be used, be it a rocker button as shown, a pivoted toggle lever having a spring-biased plunger, or a linearly slidable trigger or slide button having a spring-biased plunger thereon. Conventional means would be provided on the housing for mounting such trigger or slide button for linear sliding movement.

While the apparatus hereinbefore described is effectively adapted to fulfill the objects stated, it is to be understood that the invention is not intended to be limited to the particular preferred embodiment of plural-circuit progressive switch disclosed, inasmuch as it is susceptible of various modifications without departing from the scope of the appended claims.

I claim:

1. An electric switch comprising:

a housing comprising an insulating base having a switch compartment therein:

means on said housing supporting a switch operator;

a switch operator supported on said housing and having an actuator portion extending into said compartment for operating the switch contacts;

a rocking contactor disposed to be engaged by said actuator portion;

three spaced apart stationary contacts mounted in said base and connected to external terminals;

a flexible contactor secured to the first stationary contact and having a portion overlying the second stationary contact but biased away from the latter;

and means on said first and second stationary contacts supporting said rocking contactor for movement from a stable "off" position wherein it engages only said first stationary contact into a first stable "on" position wherein it presses said flexible contactor into engagement with said second stationary contact whereby to close one circuit and then into a second stable "on" position wherein it engages the third stationary contact while continuing to hold said flexible contactor against said second stationary contact to close two circuits.

2. The electric switch defined in claim 1 wherein:
said actuator portion of said switch operator comprises a spring-biased plunger slidable along said rocking contactor to actuate the latter into selected ones of its operating positions.

3. The electric switch defined in claim 2, wherein:
said switch operator is a rocker button supporting said spring-biased plunger for swinging movement along said rocking contactor;
and said housing comprising means pivotally supporting said rocker button over said base.

4. The electric switch defined in claim 2, wherein:
said switch operator is a linearly slidable member supporting said spring-biased plunger for sliding movement along said rocking contactor;
and said housing comprises means mounting said slidable member for limited linear sliding movement on said base.

5. The electric switch defined in claim 1 wherein:
said flexible contactor comprises an elongated metal strip having one end secured to said first stationary contact and being formed in a curved configuration so that its other end is self-biased against the lower surface of said rocking contactor over said second stationary contact.

6. The electric switch defined in claim 1 wherein:
said means on said first and second stationary contacts supporting said rocking contactor comprise:
an upstanding bifurcated portion on each of said first and second stationary contacts, with these two bifurcated portions being spaced apart to support said rocking contactor thereon in said first stable "on" position;
and said rocking contactor comprises a generally stiff elongated member bent at the middle so that both its halves extend up at a small angle to form a rockable member, and having lateral wings extending between said bifurcated portions.

7. An electric switch comprising:
a housing including an insulating base having a switch compartment therein and supporting means for supporting a switch operator on said housing;
a switch operator mounted on said supporting means and having an actuator portion extending into said compartment for operating the switch contacts;
said switch contacts comprising three spaced stationary contacts mounted to said base within said compartment and connected to external terminals, and a rocking contactor over said stationary contacts and disposed to be engaged by said actuator portion, the first and second contacts of said three spaced stationary contacts comprising a cradle having two spaced halves connected to the respective first and second contacts for supporting said rocking contactor, and a flexible contactor secured to said first stationary contact and having a portion overlying said cradle half of said second stationary contact but biased out of engagement with respect to the latter;
and said cradle supporting said rocker contactor for movement from a stable "off" position wherein it engages only said first stationary contact into a first stable "on" position wherein it presses said flexible contactor into engagement with said second stationary contact whereby to close one circuit and then into a second stable "on" position wherein it engages the third stationary contact while continuing to hold said flexible contactor against said cradle half of said second stationary contact to close two circuits.

* * * * *